US007135650B2

(12) United States Patent
Jung

(10) Patent No.: US 7,135,650 B2
(45) Date of Patent: Nov. 14, 2006

(54) CONTROL PANEL ASSEMBLY AND METHOD OF MANUFACTURING FOR THE SAME

(75) Inventor: Hye Sun Jung, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/056,190

(22) Filed: Feb. 14, 2005

(65) Prior Publication Data

US 2006/0016676 A1 Jan. 26, 2006

(30) Foreign Application Priority Data

Jul. 21, 2004 (KR) ..... 10-2004-0056796

(51) Int. Cl.
*H01H 13/04* (2006.01)
*H01H 9/18* (2006.01)

(52) U.S. Cl. ..... 200/314

(58) Field of Classification Search ..... 200/310–314
See application file for complete search history.

(56) References Cited

U.S. PATENT DOCUMENTS

| | | | | |
|---|---|---|---|---|
| 4,156,120 | A * | 5/1979 | Vaerlien et al. | 200/341 |
| 4,525,613 | A * | 6/1985 | Butts | 200/521 |
| 5,432,684 | A * | 7/1995 | Fye et al. | 200/314 |
| 5,655,826 | A * | 8/1997 | Kouno et al. | 200/314 |
| 6,160,232 | A * | 12/2000 | Lin | 200/341 |
| 6,765,503 | B1 * | 7/2004 | Chan et al. | 200/310 |
| 6,886,955 | B1 * | 5/2005 | Miyasaka | 200/314 |
| 6,928,297 | B1 * | 8/2005 | Kitamura et al. | 200/314 |

* cited by examiner

*Primary Examiner*—Michael A. Friedhofer
(74) *Attorney, Agent, or Firm*—Birch, Stewart, Kolasch & Birch, LLP

(57) ABSTRACT

There is provided a control panel assembly and method of manufacturing the same. In the control panel assembly, a control panel is disposed at a front of the control panel assembly, a button is coupled with the control panel, and a light source is disposed at a back of the button to emit a light. The button includes a body member molded with copolymer, a painted part coated on a front of the body member with a colored painting material, and a character portion carved in the painted part.

19 Claims, 5 Drawing Sheets

CONTROL PANEL ASSEMBLY AND METHOD OF MANUFACTURING FOR THE SAME

This application claims the benefit of the Korean Application No. P2004-56796 filed on Jul. 21, 2004, which is hereby incorporated by reference.

BACKGROUND OF THE INVENTION

1. Field of the Invention

The present invention relates to a control panel assembly, and more particularly, to a control panel assembly and method of manufacturing the same, which requires fewer manufacturing operations.

2. Discussion of the Related Art

Washing machine are widely used to clean laundry. The washing machine agitates the laundry together with water containing detergent by driving a pulsator or a drum. The washing machine can be classified into a pulsator type and a drum type, and the latter is being more widely used than the former because of its lower overall height and wrinkle-reducing characteristic.

The washing machine usually includes a front member with a control panel assembly. The control panel assembly is provided with a plurality of buttons on which characters are formed for the user to control the operation of the washing machine.

However, since the buttons of the control panel assembly are usually wet when the user operates the washing machine, the characters of the buttons are easily worn off when repeatedly touched.

Further, it is not easy for the user to manipulate the control panel assembly in a dark place.

SUMMARY OF THE INVENTION

Accordingly, the present invention is directed to a control panel assembly and method of manufacturing the same that substantially obviates one or more problems due to limitations and disadvantages of the related art.

An object of the present invention is to provide a control panel assembly and method of manufacturing the same, which can improve productivity and reduce manufacturing cost.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control panel assembly includes: a control panel disposed at a front of the control panel assembly; a button coupled with the control panel, the button having a body member molded with copolymer, a painted part coated on a front of the body member with a colored painting material, and a character portion carved in the painted part; and a light source disposed at a back of the button to emit a light toward the body member.

The copolymer may include an ABS copolymer. The copolymer may also include a colored pigment to adjust the color of the light passing through the body member. The color of the colored pigment may be substantially the same as the color of the light emitted from the light source.

Further, the copolymer may include a diffusion pigment to adjust the brightness of the light passing through the body member. The diffusion pigment may include a powdered transparent pigment. The character portion may denote a function of the button. The light source may include a light emitting diode (LED) lamp. The painted part may include a colored material to intercept light.

The body member may include a supporting part extended from a rim, the supporting part being coupled to the control panel. The supporting part may define a spiral elastic slot.

In another aspect of the present invention, a method of manufacturing a control panel assembly, includes: molding copolymer into a body member; forming a painted part on a front of the body member with a colored painting material; and carving a character portion in the painted part.

The molding may further include adding a colored pigment to the copolymer. The molding may further include adding a diffusion pigment to the copolymer.

The carving may include selectively removing the painted part with a laser beam to form the character portion.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
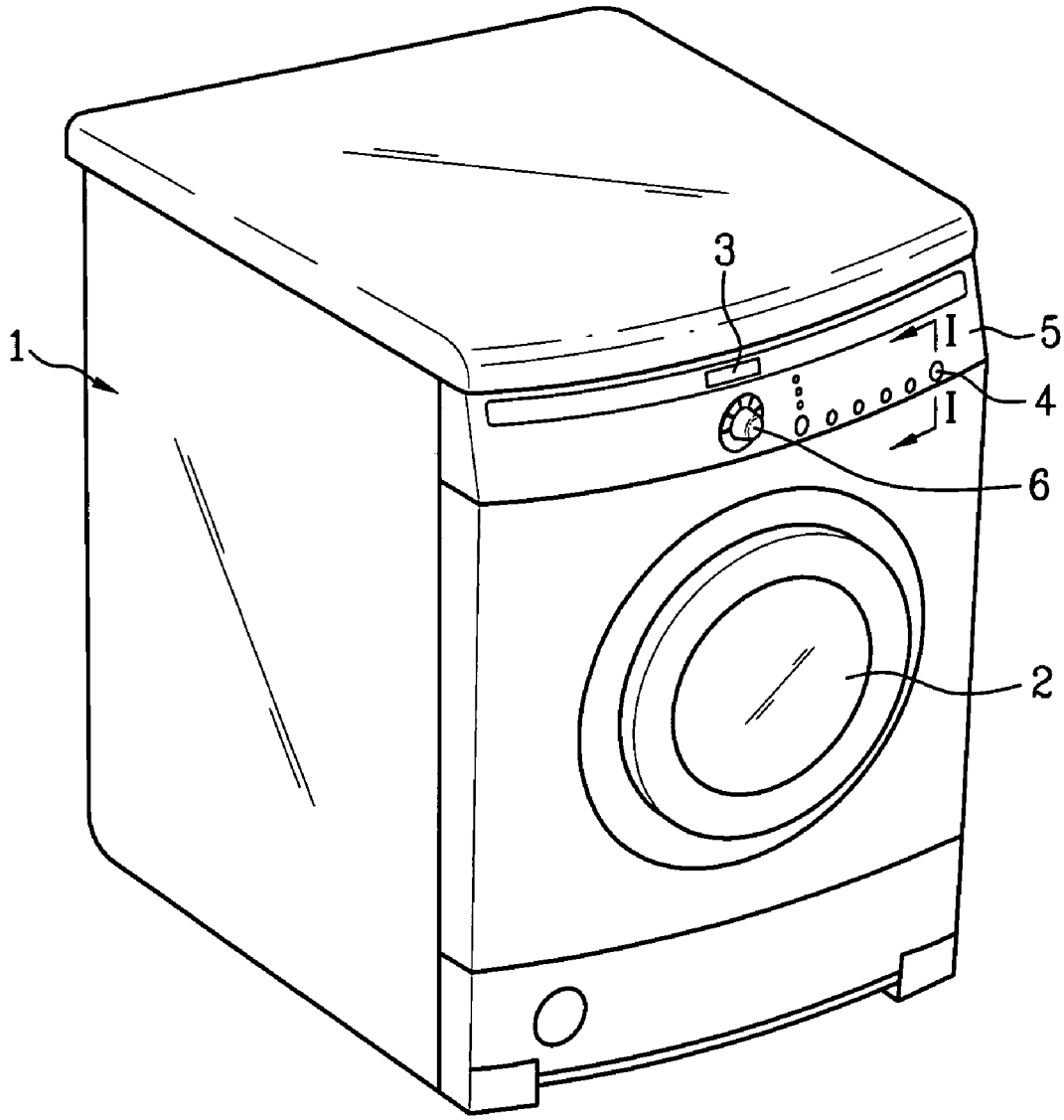
FIG. 1 is a perspective view of a washing machine with a control panel assembly according to the present invention.

FIG. 1 is a perspective view of a washing machine with a control panel assembly according to the present invention.

Referring to FIG. 1, an exemplary drum-type washing machine is illustrated to describe a control panel assembly of the present invention. The drum-type washing machine includes a main body 1. The main body 1 defines an opening (not shown) at a front to put in and take out laundry through it. Further, the drum-type washing machine includes a door 2 and a control panel assembly. The door 2 is hinged on a front of the main body 1 to open and close the opening, and the control panel assembly is disposed at a front top of the main body 1. A user can operate the drum-type washing machine by manipulating the control panel assembly.

The control panel assembly includes a display 3, a plurality of buttons 10, a knob 6, and a control panel 5. A circuit board and a controller, not shown, may be disposed inside of the panel 5 to operate internal components such as a motor upon the user's manipulation of the control panel assembly.

Figure 2A:
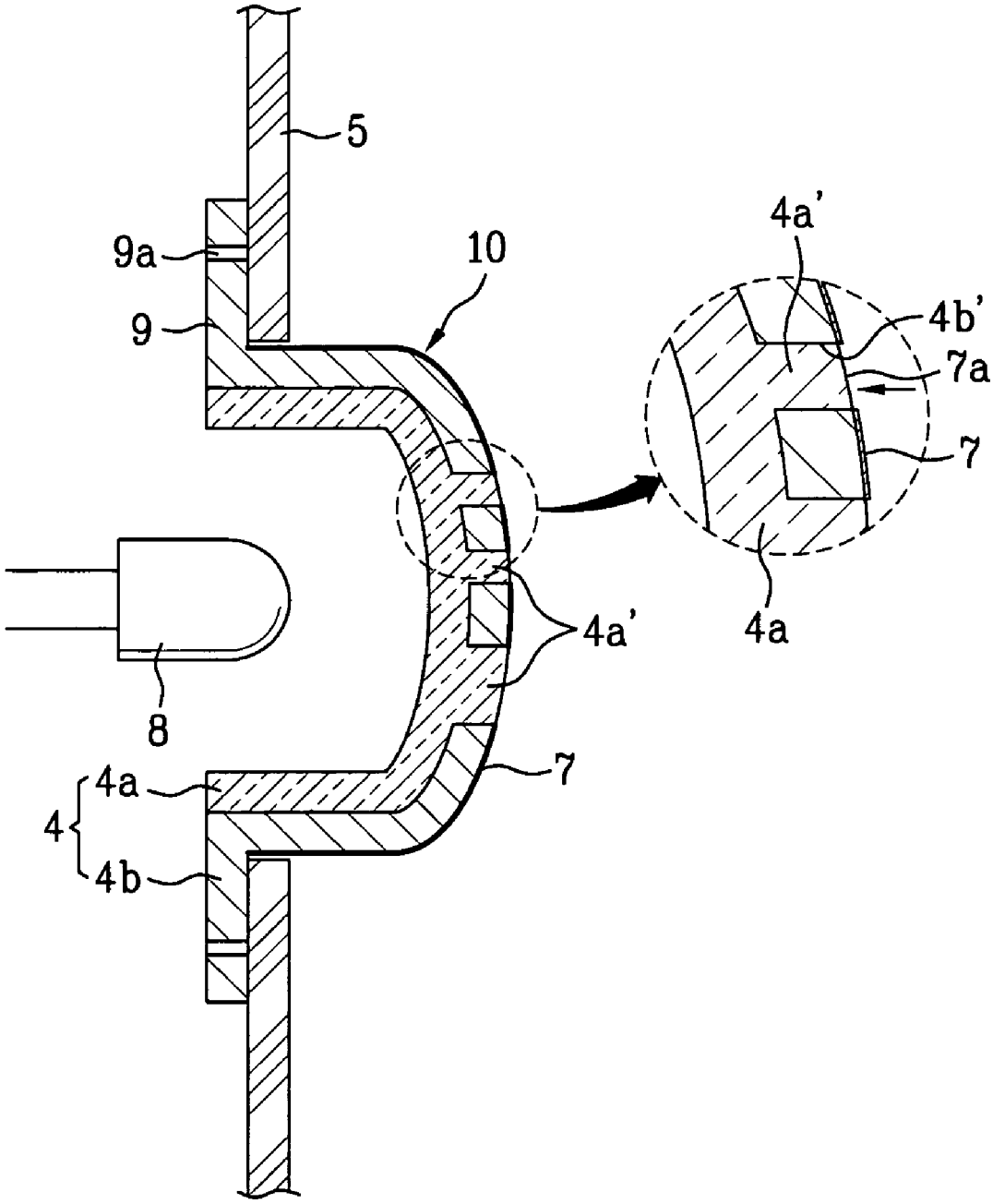
FIG. 2A is a side sectional view taken on line I—I in FIG. 1.
Figure 2B:
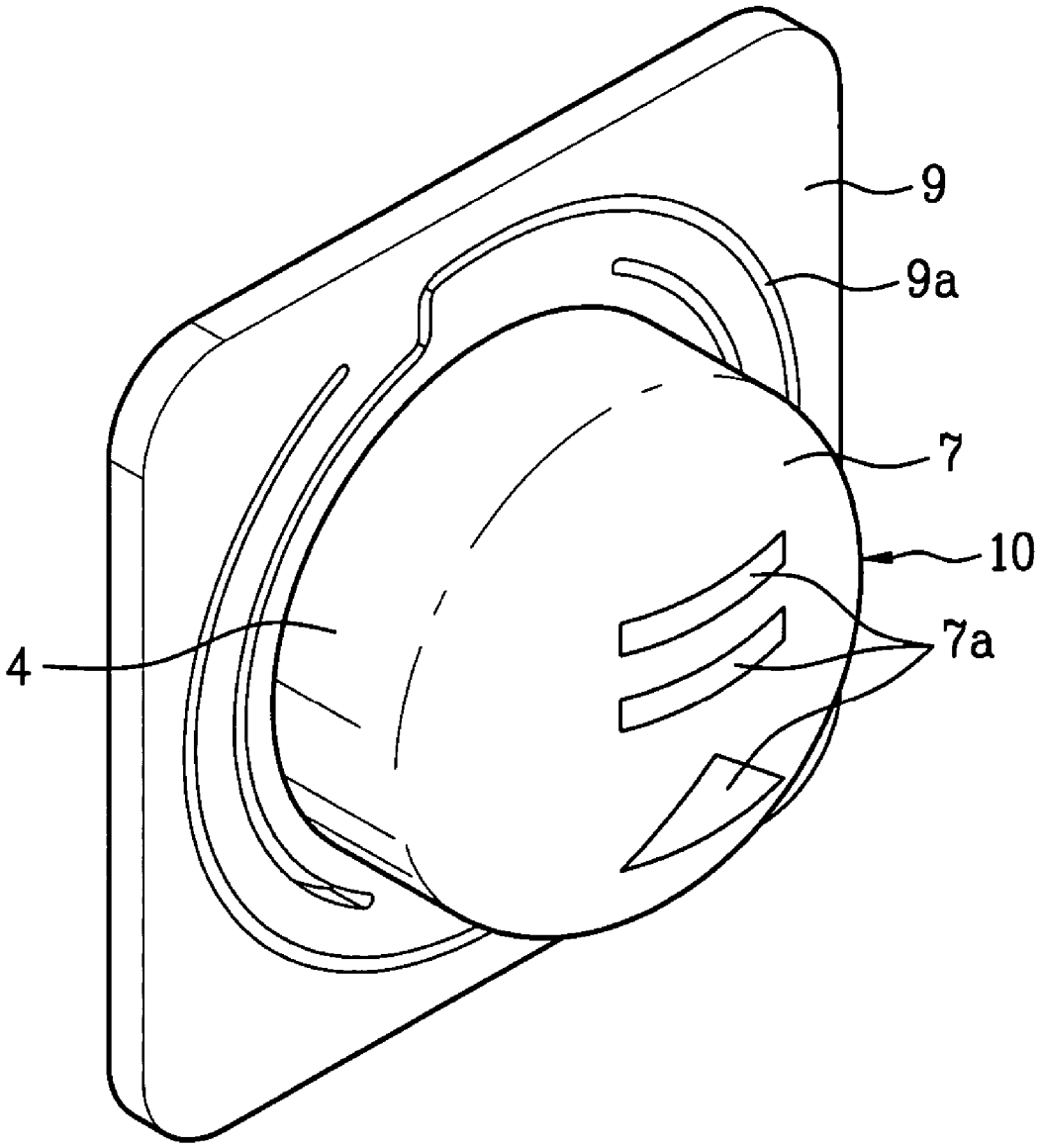
FIG. 2B is a perspective view of a button of a control panel assembly according to an embodiment of the present invention.

FIG. 2A is a side sectional view taken on line I—I in FIG. 1, illustrating a button of a control panel assembly according to an embodiment of the present invention, and FIG. 2B is a perspective view of a button depicted in FIG. 2A.

Referring to FIGS. 2A and 2B, a light emitting diode (LED) lamp 8 is placed at a back of the control panel 5. The LED lamp 8 may be electrically connected to the circuit board (not shown). The button 10 is shaped like a hat and the LED lamp 8 is placed in the opened back of the button 10.

The button 10 includes a body member 4 with a rear member 4*a* and a front member 4*b*. The rear member 4*a* may be injection molded with transparent acrylic, and the front member 4*b* is coupled to the rear member 4*a* from the front and may be injection molded with acrylonitrile butadiene styrene (ABS) copolymer.

A letter or character 4*a*' is embossed on a front face of the rear member 4*a*. The front member 4*b* is made of opaque material and it defines a hole 4*b*' to receive the embossed letter or character 4*a*', such that the user can recognize the function of the button 10 according to the embossed letter or character 4*a*'.

After the rear member 4*a* and the front member 4*b* are coupled, the front surface of the body member 4 is painted to form a painted part 7 with a predetermined color. The painted part 7 may be formed by spraying a predetermined painting material.

Then, a laser beam is scanned to remove some portion of the painted part 7 corresponding to the letter or character 4*a*', such that a character portion 7*a* is formed at a front of the button 10. Light emitted from the LED lamp 8 can be seen from the outside through the character portion 7*a*.

In other words, the light of the LED lamp 8 passes through the embossed letter or character 4*a*' of the rear member 4*a* to illuminate the character portion 7*a*' of the button 10, such that the user can easily recognize the button 10 in a dark place.

In this way, the painted part 7 and the character portion 7*a* are formed at the front of the button 10.

Further, the body member 4 includes a supporting part 9 at a rim thereof. The supporting part 9 attaches to a back of the control panel 5 and defines elastic slot 9*a* with a spiral shape. The supporting part 9 is elastic around the elastic slot 9*a*, such that when the supporting part 9 is connected to the back of the control panel 5 the elastic slot 9*a* functions like a spring. Therefore, the body member 4 can return to its original position when pressed.

Figure 3:
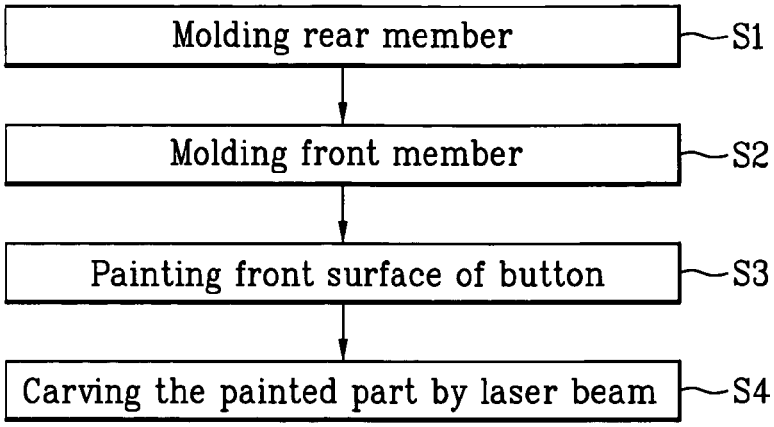
FIG. 3 is a flowchart of a method of manufacturing a button of a control panel assembly according to an embodiment of the present invention.

FIG. 3 is a flowchart of a method of manufacturing a button of a control panel assembly according to an embodiment of the present invention.

Referring to FIG. 3, the rear member 4*a* is molded with acrylic in operation S1, and the front member 4*b* is molded with ABS copolymer in operation S2. In operation S3, the rear member 4*a* and the front member 4*b* are coupled, and a painting material is sprayed to the front surface of the button 10 to form the painted part 7.

In operation S4, the painted part 7 is carved using a laser beam to expose the embossed letter or character 4*a*' of the rear member 4*a*, thereby forming the character portion 7*a* on the front of the button 10.

In this embodiment, the rear member 4*a* and the front member 4*b* are coupled to form the body member 4. Therefore, the embossed letter or character 4*a*' of the rear member 4*a* is exactly matches to the hole 4*b*' of the front member 4*b* when they are assembled.

Further, the carving of the painted part 7 is precisely carried out to exactly match the character portion 7*a* to the embossed letter or character 4*a*' of the rear member 4*a*, such that the letter or character can be clearly recognized.

Figure 4:
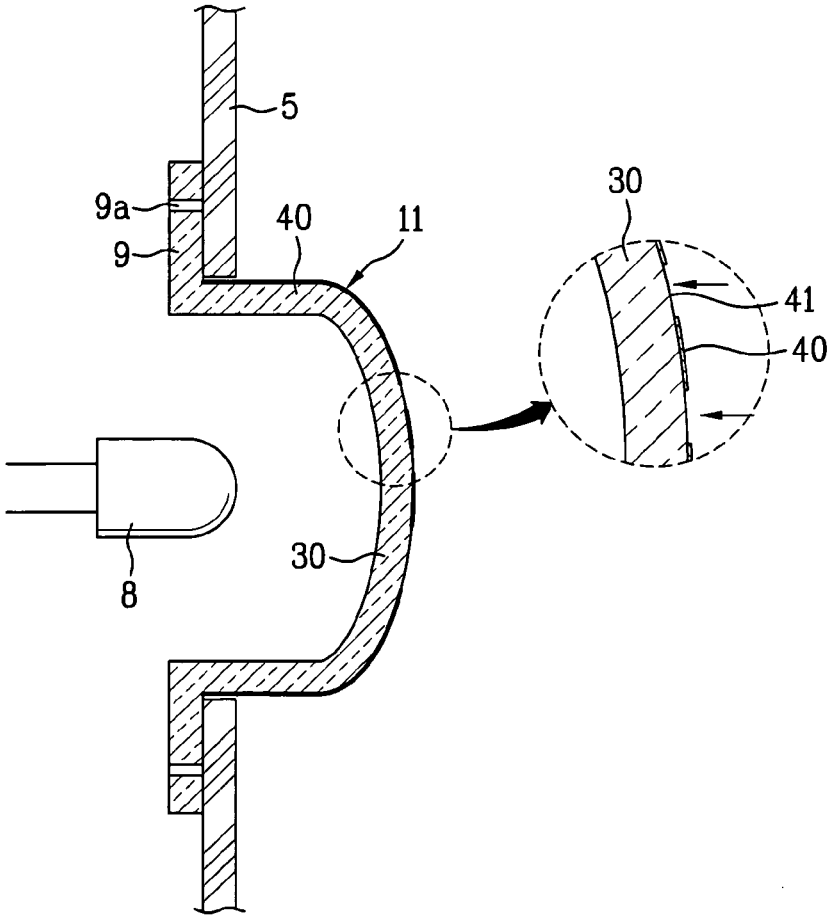
FIG. 4 is a side sectional view of a button of a control panel assembly according to another embodiment of the present invention.

FIG. 4 is a side sectional view of a button of a control panel assembly according to another embodiment of the present invention.

Referring to FIG. 4, a button 11 includes a body member 30 and a painted part 40. Also, the button 11 includes a supporting part 9 at a rim. The supporting part 9 attaches to a back of a control panel 5. A light source such as an LED lamp 8 is placed at a back of the button 11. The LED lamp 8 may be electrically connected to a circuit board (not shown) disposed at a back of the control panel. The LED lamp 8 is placed to emit light toward the button 11.

An elastic slot 9*a* of the supporting part 9 and the electrical connection the LED lamp 8 have the same structure as described above.

The body member 30 of the button 11 is shaped like a hat and encloses the LED lamp 8. The body member 30 may be made of ABS copolymer with a colored pigment and a diffusion pigment. The colored pigment is added to adjust the color of the light illuminated through the body member 30, and the diffusion pigment is added to adjust the brightness and irradiation (spreading) of the light illuminated through the body member 30. Further, the body member 30 includes a colored painted part 40 at a front surface. The painted part 40 is carved using a laser beam to define a character portion 41.

The body member 30 is capable of transmitting a light. The colored pigment may be a powdered pigment with the same color as the light of the LED lamp 8 to clearly maintain the color of the light from the LED lamp 8 without distortion.

The painted part 40 may be formed by spraying a predetermined painting material and then the painted part 40 is selectively removed using a laser scan device (not shown) to expose the surface of the body member 30. The selectively exposed surface of the body member 30 defines the character portion 41.

The operation of the button according to another embodiment of the present invention will not be described.

The body member 30 is integrally molded with ABS copolymer, the colored pigment, and the diffusion pigment. The painted part 40 is formed by spraying a predetermined painting material to the front of the body member 30, and then the laser beam is applied to the painted part to carve the character portion 41 in the painted part 40.

The integral forming of the body member 30 leads to lower cost and higher productivity.

Further, since the colored pigment and the diffusion pigment are added, the brightness and irradiation of the light illuminated from the character portion 41 can be adjusted.

A method of manufacturing a button of a control panel assembly will be described according to another embodiment of the present invention.

Figure 5:
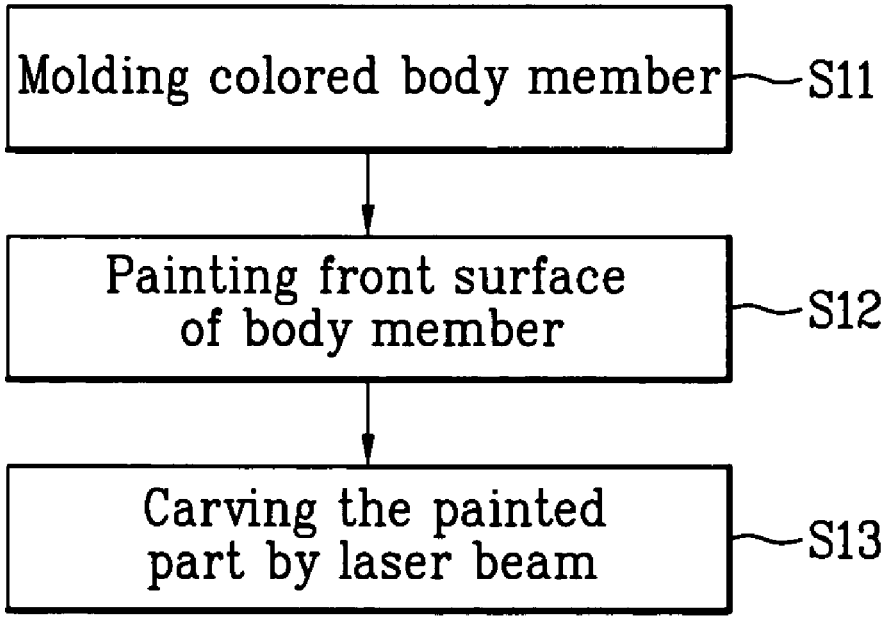
FIG. 5 is a flowchart of a method of manufacturing a button of a control panel assembly according to another embodiment of the present invention.

FIG. 5 is a flowchart of a method of manufacturing a button of a control panel assembly according to another embodiment of the present invention.

Referring to FIG. 5, in operation S11 the body member 30 of the button 11 is molded with colored ABS copolymer. In operation S12, a colored painting material is sprayed to the front surface of the body member 30 to form the painted part 40. In operation S13, the painted part 40 is carved using a laser beam to form the character portion 41.

In this embodiment, adding a colored pigment may be included in operation S11 to adjust the color and irradiation of the light to be illuminated through the body member 30. Further, adding a diffusion pigment may be included in operation S11 to adjust the brightness of the light to be illuminated through the body member 30.

The button of the present invention has the following advantages.

First, the integral forming of the body member leads to lower cost and higher productivity. That is, embossing of letter or character is not required since the body member is formed in one-piece.

Second, the painted part is painted on the integrally formed body member and then the painted part is carved to form the character portion, such that manufacturing time and defective proportion can be reduced.

The structure of the button of the present invention can be applied to other parts such as a knob. Further, the structure can be applied to various types of washing machines such as a pulsator-type washing machine as well as a drum-type washing machine.

As described above, manufacturing operations and costs can be reduced, and productivity can be improved according to the present invention.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A control panel assembly comprising:

a control panel disposed at a front of the control panel assembly;

a button coupled with the control panel, the button having a copolymer body member a colored paint layer located on a front of the copolymer body member, and a character portion located in the paint layer and exposing the copolymer body member; and a light source disposed at a back of the button to emit a light toward the copolymer body member, wherein the copolymer body member includes a colored pigment to adjust the color of the light passing through the copolymer body member, and a diffusion pigment to adjust the brightness of the light passing through the copolymer body member.

2. The control panel assembly of claim 1, wherein the copolymer body member includes an acrylonitrile butadiene styrene (ABS) copolymer.

3. The control panel assembly of claim 1, wherein the color of the colored pigment is substantially the same as the color of the light emitted from the light source.

4. The control panel assembly of claim 1, wherein the diffusion pigment includes a powdered transparent pigment.

5. The control panel assembly of claim 1, wherein the character portion denotes a function of the button.

6. The control panel assembly of claim 1, wherein the light source includes a light emitting diode (LED) lamp.

7. The control panel assembly of claim 1, wherein the paint layer includes a colored material to intercept light.

8. The control panel assembly of claim 1, wherein the copolymer body member includes a supporting part extended from a rim, the supporting part being coupled to the control panel.

9. A control panel assembly comprising:

a control panel disposed at a front of the control panel assembly;

a button coupled with the control panel, the button having a copolymer body member, a colored paint layer located on a front of the copolymer body member, a character portion located in the paint layer and exposing the copolymer body member, a supporting part extending from a rim and being coupled to the control panel, the supporting part defining a spiral elastic slot; and a light source disposed at a back of the button to emit a light toward the copolymer body member.

10. The control panel assembly of claim 9, wherein the copolymer body member includes a front member and a rear member, the rear member having an embossed character formed thereon, the embossed character corresponding to the character portion formed in the paint layer.

11. The control panel assembly of claim 10, wherein the front member is formed of an acrylonitrile butadiene styrene (ABS) copolymer and the rear member is formed of a transparent acrylic.

12. The control panel assembly of claim 10, wherein the front member defines a hole that is configured to receive the embossed character.

13. A method of manufacturing a control panel assembly, comprising:

molding copolymer into a copolymer body member, wherein the molding copolymer includes adding a colored pigment and a diffusion pigment to the copolymer;

forming a paint layer on a front of the copolymer body member with a colored painting material; and selectively removing a character portion in the paint layer.

14. The method of claim 13, wherein the selectively removing the paint layer includes using a laser beam to form the character portion.

15. A control panel assembly comprising:

a control panel disposed at a front of the control panel assembly;

a button coupled with the control panel, the button having a copolymer body member having a front member and a rear member, the rear member including an embossed character formed thereon, a colored paint layer located on a front of the copolymer body member, and a character portion located in the paint layer and exposing the embossed character; and a light source disposed at a back of the button to emit a light toward the copolymer body member.

16. The control panel assembly of claim 15, wherein the character portion denotes a function of the button.

17. The control panel assembly of claim 15, wherein the light source includes a light emitting diode (LED) lamp.

18. The control panel assembly of claim 15, wherein the front member is formed of an acrylonitrile butadiene styrene (ABS) copolymer and the rear member is formed of a transparent acrylic.

19. The control panel assembly of claim 15, wherein the front member defines a hole that is configured to receive the embossed character.

* * * * *